United States Patent [19]

Vigna, deceased et al.

[11] Patent Number: 4,834,671

[45] Date of Patent: May 30, 1989

[54] DEVICE FOR CONNECTING ELECTRICAL CABLES

[75] Inventors: Bernardino Vigna, deceased, late of Turin; by Luisa Saccinni ved. Vigna, heir, Via Renier 11, 10141 Torino; by Stefania Vigna in Gregnanin, heir; by Daniela Vigna in Chiesa, heir, both of Turin; Michelle Buzzetti, Turin, all of Italy

[73] Assignee: Luisa Saccinni ved. Vigna, Turin, Italy

[21] Appl. No.: 148,527

[22] Filed: Jan. 26, 1988

[30] Foreign Application Priority Data

Feb. 16, 1987 [IT] Italy ..... 53005/87[U]

[51] Int. Cl.[4] ..... H01R 4/26

[52] U.S. Cl. ..... 439/416; 439/415

[58] Field of Search ..... 439/411, 415, 416, 431, 439/433, 786, 787, 791, 794

[56] References Cited

U.S. PATENT DOCUMENTS 2,651,026 9/1953 Roth ..... 439/431

3,688,246 8/1972 Toedtman et al. ..... 439/433

*Primary Examiner*—Gary F. Paumen

*Attorney, Agent, or Firm*—Sughrue, Mion, Zinn, Macpeak & Seas

[57] ABSTRACT

A device for connecting insulated electrical cables (C) comprises a pair of clamps (110) each provided with an engagement block (13) and a fork-shaped slider (15) resiliently snap-engaged for sliding in two holes in the block (13). Each block (13) and each slider (15) has a through-hole for the passage of a self-tapping screw both for piercing the insulation (G) of the adjacent electrical cables (C) to enable their electrical connection, and for enabling the pair of clamps (110) to be clamped.

10 Claims, 3 Drawing Sheets

DEVICE FOR CONNECTING ELECTRICAL CABLES

BACKGROUND OF THE INVENTION

The present invention relates to a device for connecting electrical cables having a central conducting core and an insulating sheath.

With the use of currently known devices, for example, screw clamps, the branch connection of one electrical cable to another requires preparation of the ends of the cables to be branch-connected to the distribution cable. This preparation, with removal of a portion of the insulating sheath, requires some skill on the part of the operator and a considerable amount of time. Furthermore, with current devices, when two branches are to be supplied by a single distribution conductor, it is necessary to provide two sections of the electrical cable to be connected to the device.

SUMMARY OF THE INVENTION

The object of the present invention is to provide a device of the type specified at the beginning of the description, which does not have the above inconveniences and which is simple and economical to produce.

According to the invention, this object is achieved by virtue of the fact that the device comprises a pair of insulating elements each provided with a connecting surface, a through-hole whose axis is substantially perpendicular to the connecting surface, and a seat adapted to house a portion of electrical cable and communicating with the through-hole; and a screw element which is adapted to be housed in the through-holes and screwed into the central conducting cores of two cables inserted respectively into the seats of the two insulating elements whose connecting surfaces are in contact with each other, so as to achieve both a mechanical connection between the elements and the cables inserted in the seats of the elements and an electrical connection between the cables.

By virtue of these characteristics, the branch connection of a cable to a main distribution cable is notably quick, safe and easy to carry out. Moreover, when two branches are to be supplied by a single distribution cable, a single section of cable can be used without the need to cut it into two sections and to prepare the ends to be connected to the clamp connected to the distribution cable.

Preferably, each of these insulating elements comprises a clamp provided with a base and a slider mounted for sliding relative to the base, the base and the slider having respectively a first and a second hole for the passage of the screw element for enabling the clamps to be clamped in a configuration facing each other.

According to another characteristic, each base is parallelepipedal in shape and is provided with a flat appendage arranged substantially on one face of the base parallel to the axis of the first hole, the appendage being removable from the base when the device is used.

By virtue of the above characteristics, a single type of clamp may be used for connecting electrical cables which have a wide range of diameters. Furthermore, the removable appendage permits safe insulation of the end of the central conducting core of a cable when it is branch-connected to a main conductor.

BRIEF DESCRIPTION OF THE DRAWINGS

Further advantages and characteristics of the device according to the invention will become clear from the detailed description which follows, provided purely by way of non-limiting example, with reference to the appended drawings, in which.

DETAILED DESCRIPTION OF THE INVENTION

Figure 1:
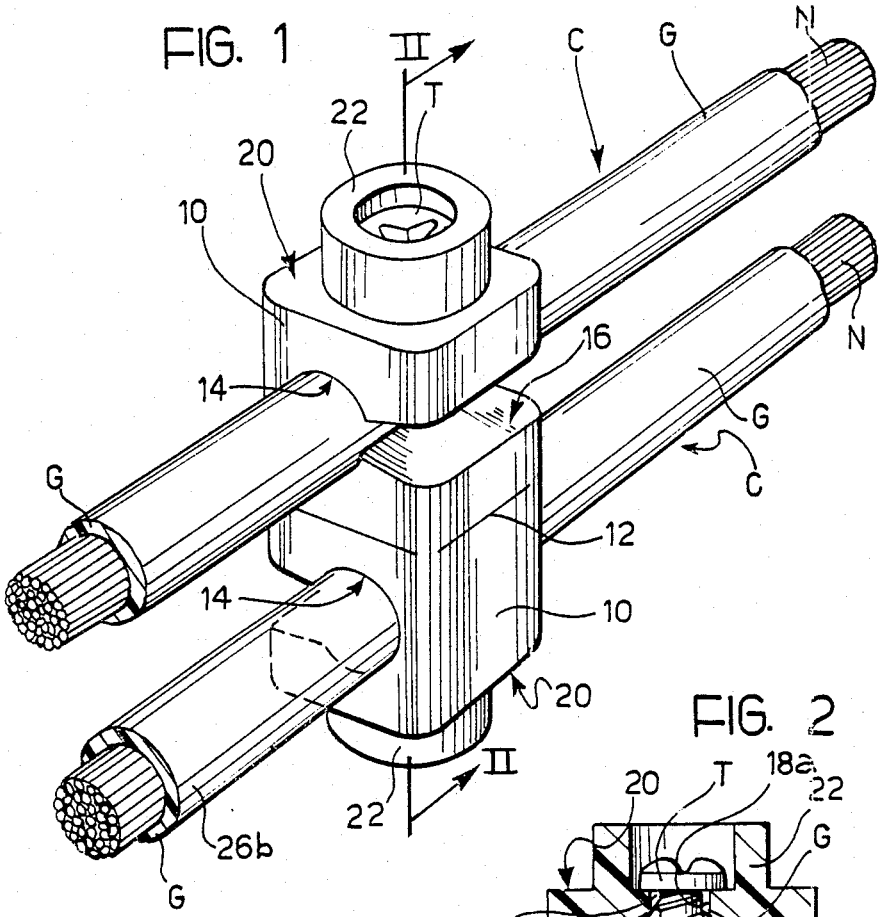
FIG. 1 is a perspective view which shows a first embodiment of a device according to the invention in the operative configuration.

With reference to the drawings, two cube-like insulating elements, for example of polyamide resin, are indicated 10. Each element 10 has a flat connecting face 12 arranged to face a corresponding flat face 12 of another insulating element 10 when the device is assembled as shown in the drawings.

Each insulating element 10 has a cylindrical seat 14 which is parallel to the connecting face 12 and has a fitting groove 16 whose function will be clear in the following description. Each insulating element 10 has a through-hole 18 which is perpendicular to the connecting face 12 and the cylindrical seat 14 and is divided by the seat 14 into a first portion 18*a* adjacent a face 20 opposite the connecting face 12 and a second portion 18*b* adjacent the connecting face 12. A self-tapping screw V with a screw head T is inserted in the holes 18 of each element 10. When it is tightened, the head T of the screw V is engaged in a circular seat 22 in the face 20 of the element 10. The diameter of the portion 18*a* of the hole 18 is greater than the diameter of the threading of the screw V; the diameter of the portion 18*b* is such as to interact with the threads of the screw V.

When the device is used, the seat 14 of an insulating element 10 is resiliently snap-engaged onto an electrical cable C comprising an electrically conductive core N and an insulating sheath G, the engagement taking place through the aforementioned groove 16 in the element 10; the electrical cable C may consist, for example, of a cable for the distribution of electricity. In a similar manner, a second insulating element 10 is resiliently snap-engaged onto a second electrical cable C, for example a branch, also comprising a core of electrically conductive material N and an insulating sheath G.

The self-tapping screw V is then inserted through one of the faces 20 of each element 10 and, by means of its rotation, pierces both the sheaths G and the electrically conductive cores N, normally consisting of copper wires. In this way, the two insulating elements 10 are mechanically connected to each other, both by the interaction of the self-tapping screw V with the portions 18*b* of the holes 18 and by the clamping of the screw V on the electrical cables C. The screw V also acts as an electrical bridge between the cores N of the electrical cables C, thus connecting them electrically.

The device according to the invention may be used to advantage for connecting more than two cables, even with different diameters, simply by the use of screws V of appropriate length and insulating elements of suitable dimensions.

Figure 2:
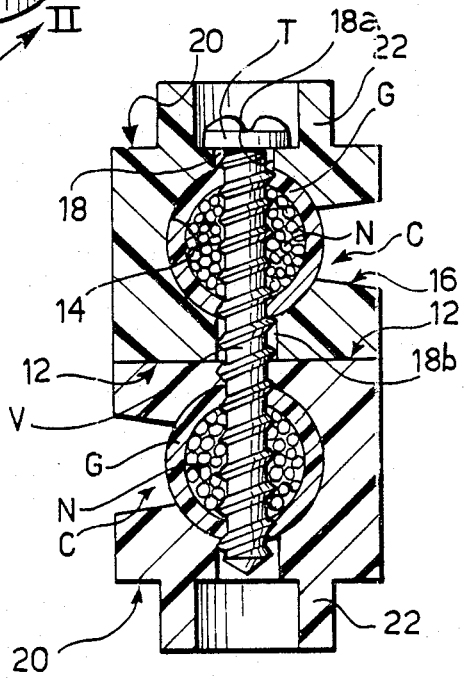
FIG. 2 is a section taken on the line II—II of FIG. 1.
Figure 3:
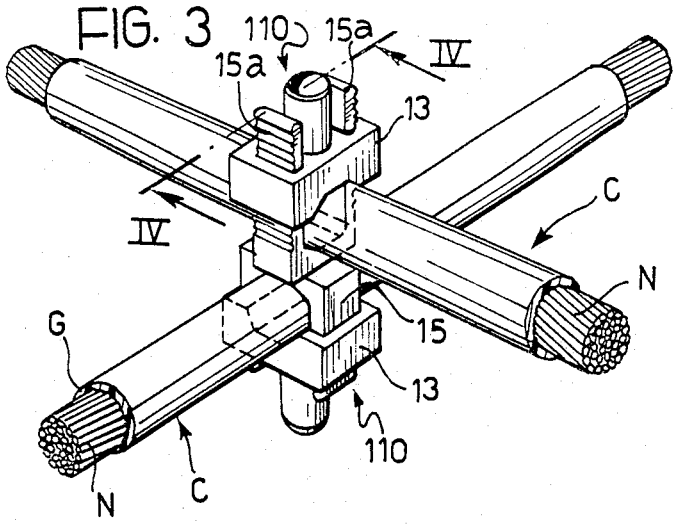
FIG. 3 is a perspective view similar to FIG. 1 and shows a second embodiment of the device.

FIGS. 3–8 show a second embodiment of the device according to the invention. In these drawings, the same reference numerals as in FIGS. 1–2, increased by 100, have been used for similar elements.

A clamp of plastics material is indicated 110 and comprises a base 13 and a fork-shaped slider 15. The base 13, which is parallelepipedal in shape, has a throughhole 118*a* with an axis X—X and two rectangular holes 17 arranged beside the hole 118*a*, whose purpose will become clear in the following description. A flat appendage 19 of reduced thickness is arranged as an extension of a side face 13*a* of the base 13 and, in correspondence with the hole 118*a*, the base 13 has a projecting tubular portion 122 coaxial with the hole 118*a*.

Figure 6:
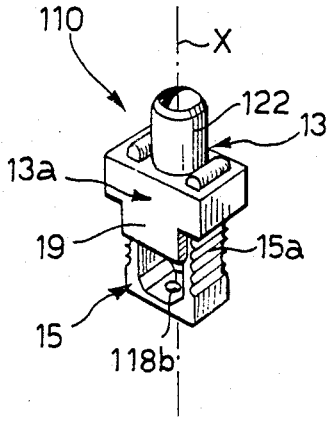
FIG. 6 is a perspective view of a clamp forming part of the device according to the invention.
Figure 5:
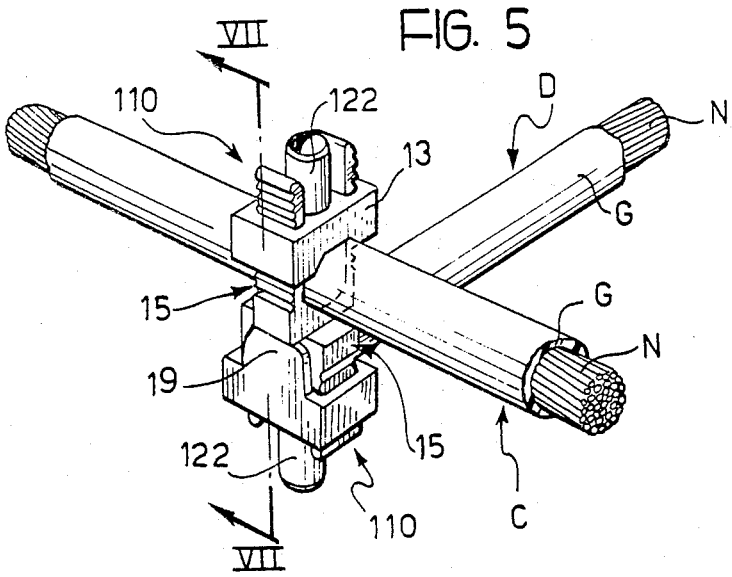
FIG. 5 is a perspective view similar to FIG. 3 and shows a device according to the invention in an operative configuration connecting a main cable and a branch cable.
Figure 7:
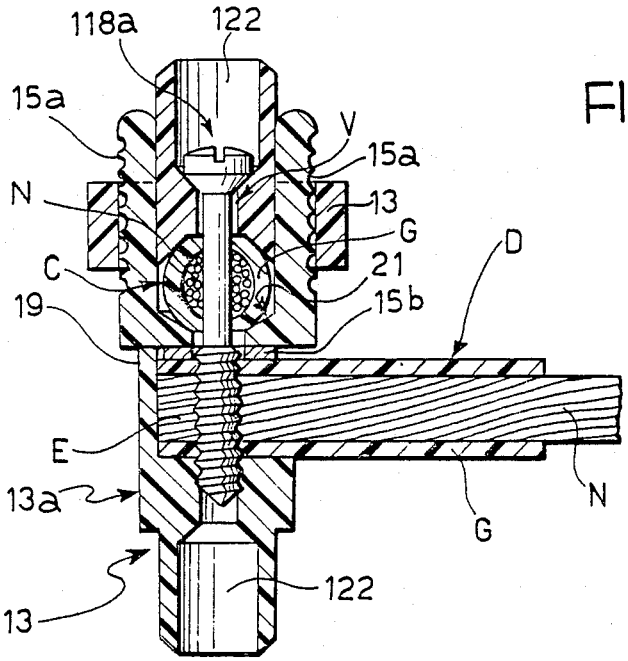
FIG. 7 is a section taken on the line VII—VII of FIG. 5.
Figure 8:
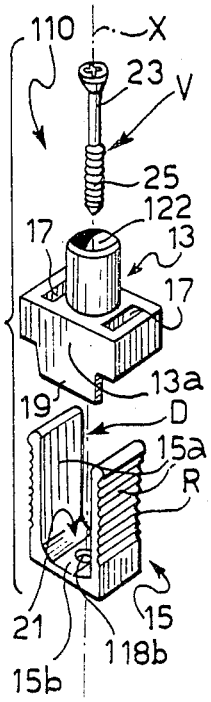
FIG. 8 is an exploded perspective view of the clamp of FIG. 6.

The slider 15 has tabs 15*a* with toothed surfaces R and a central part 15*b* defining a surface 21 which faces the tabs 15*a* and has a substantially V-shaped section; furthermore, the central part 15*b* has a through-hole 118*b* which is coaxial with the axis X—X of the hole 118*a* when the clamp is in the assembled configuration (FIG. 6).

When two insulated electrical cables C are connected, each cable is gripped between the base 13 and the slider 15 of the clamp 110, after the prior manual removal of the flat appendages 19 of the two bases 13. The toothed surfaces R of the tabs 15*a* cooperate with the corresponding holes 17 of the respective base 13 and enable the cables C to be kept gripped in the clamps 110 even after manual "compression" of the base 13 and the slider 15 has stopped.

Figure 4:
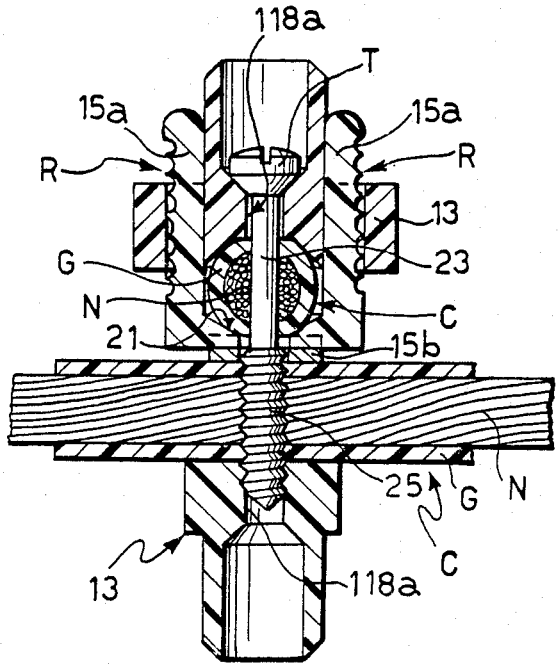
FIG. 4 is a section taken on the line IV—IV of FIG. 3.

A self-tapping screw V having a head T and a shank provided with a non-threaded portion 23 adjacent the head T and a threaded end portion 25 is then inserted in one of the holes 118*a*; as clearly shown in FIG. 4, the screw V is screwed into the cables C, piercing the sheaths G and the electrically conductive cores N, until it is screwed into the base 13 opposite the head T. In this configuration, subsequent tightening of the screw V causes both a further clamping between the two clamps 110 facing each other in correspondence with the central parts 15*b* of the sliders 15 and a further clamping of the sliders 15 relative to the bases 13. Upon completion of this clamping, the head T of the screw V is enclosed in the tubular portion 122, ensuring perfect insulation of the joint.

When a main cable C and a branch cable D are to be connected, the appendage 19 is only removed from one base 13, since the appendage 19 of the clamp 110 used to grip the branch cable D insulates the end, indicated E, of the central conducting core N of the branch cable D.

The particular shape of the surface 21 of the central part 15b of the slider 15 enables the clamps 110 to be used for electrical cables which have outside diameters which may vary over a wide range, without the need to provide different clamps for each diameter of electrical cable.

We claim:

1. A device for connecting electrical cables having a central conducting core and an insulating sheath, characterised in that it comprises:

a pair of insulating elements (10, 110) each provided with a connecting surface (12), a through-hole (18, 118) whose axis is substantially perpendicular to the connecting surface (12), and a seat (14, 16, 21) adapted to house a portion of one of the electrical cables (C,D) and communicating with the through-hole (18, 118), and a screw element (V) which is adapted to be housed in the through-holes (18, 118) and screwed into the central cores (N) of the cable (C,D) inserted respectively into the two seats (14, 21) of the two insulating elements (10, 110) whose connecting surfaces (12) are substantially in contact with each other, so as to achieve both a mechanical connection between the elements (10, 110) and the cables (C,D) inserted in the seats (14, 21) of the elements (10, 110) and an electrical connection between the cables.

2. A device according to claim 1, characterised in that each of the elements (10) is shaped substantially as a parallelepiped, one face (12) of which constitutes the connecting surface, and in that each said seat for the electrical cables (C) is constituted by an additional hole (14) whose axis is substantially perpendicular to the axis of the through-hole (18) for housing the screw element (V).

3. A device according to claim 2, characterised in that one face of each said element (10) adjacent the connecting surface (12) and substantially parallel to the axis of the additional hole (14) has a shaped notch (16) which communicates with the inside of the additional hole (14) for enabling the electrical cable (24, 26) to be inserted laterally into the additional hole (14).

4. A device according to claim 1, characterised in that each of the insulating elements comprises a clamp (110) provided with a base (13) and a slider (15) mounted for sliding relative to the base (13), the base (13) and the slider (15) having respectively a first and a second hole (118*a*, 118*b*) for the passage of the screw element (V) for enabling the clamps (110) to be clamped in a configuration facing each other.

5. A device according to claim 4, characterised in that each slider (15) is fork-shaped and has tabs (15*a*) for sliding in holes (17) in the respective base (13) beside the first hole (118*a*), and a central part (15*b*) in which the second hole (118*b*) is formed.

6. A device according to claim 5, characterised in that each base (13) is parallelepipedal in shape and has a flat appendage (19) arranged substantially on one face (13*a*) of the base (13) parallel to the axis (X—X) of the first hole (118*a*), the appendage (19) being removable from the base (13).

7. A device according to claim 5, characterised in that the tabs (15*a*) of each slider (15) have toothed surfaces (R) for resiliently snap-engaging in the respective holes (17) of the base (13) to retain the slider (15).

8. A device according to claim 5, characterised in that the central part (15*b*) of each slider (15) has the seat (21) facing the tabs (15*a*) and each base has a substantially V-shaped section for clamping electrical cables (C, D) of different diameters.

9. A device according to claim 5, characterised in that the screw element (V) has, adjacent its head (T), a non-threaded portion (23).

10. A device according to claim 6, characterised in that each base (13) has, on one face through which the screw element (V) is inserted, a tubular portion (122) coaxial with the first hole (118*a*) for housing the head (T) of the screw element (V).

* * * * *